US011054160B2

(12) United States Patent
Shah et al.

(10) Patent No.: US 11,054,160 B2
(45) Date of Patent: Jul. 6, 2021

(54) SIMULTANEOUS HEATING AND COOLING OF MULTIPLE ZONES

(71) Applicant: Carrier Corporation, Jupiter, FL (US)

(72) Inventors: Rajendra K. Shah, Indianapolis, IN (US); Bradley D. Powell, Greenwood, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 307 days.

(21) Appl. No.: 15/197,883

(22) Filed: Jun. 30, 2016

(65) Prior Publication Data

US 2017/0003044 A1 Jan. 5, 2017

Related U.S. Application Data

(60) Provisional application No. 62/187,556, filed on Jul. 1, 2015.

(51) Int. Cl.

| | |
|---|---|
| ***F24F 11/30*** | (2018.01) |
| ***F24F 11/62*** | (2018.01) |
| *F24F 11/65* | (2018.01) |
| *F24F 11/61* | (2018.01) |

(52) U.S. Cl.

CPC ..... *F24F 11/30* (2018.01); *F24F 11/62* (2018.01); *F24F 11/61* (2018.01); *F24F 11/65* (2018.01); *F24F 2221/54* (2013.01)

(58) Field of Classification Search

CPC ..... F24F 11/006; F24F 2221/54; F24F 2011/0064; F24F 2011/0073

See application file for complete search history.

(56) References Cited

U.S. PATENT DOCUMENTS

| | | | | |
|---|---|---|---|---|
| 3,305,001 | A | 2/1967 | Hefler et al. | |
| 3,933,197 | A | 1/1976 | Zimmer et al. | |
| 4,200,910 | A * | 4/1980 | Hall | G05D 23/20 165/11.1 |
| 4,495,986 | A | 1/1985 | Clark et al. | |
| 4,830,095 | A | 5/1989 | Friend | |

(Continued)

FOREIGN PATENT DOCUMENTS

| | | | |
|---|---|---|---|
| JP | H04161750 | A * | 6/1992 |
| JP | 2003083657 | A * | 3/2003 |

OTHER PUBLICATIONS

Maeda et al., Refrigerator and Method for Operating Refrigerator, Mar. 19, 2003, JP2003083657A, Whole Document.*

(Continued)

*Primary Examiner* — Larry L Furdge

(74) *Attorney, Agent, or Firm* — Cantor Colburn LLP

(57) ABSTRACT

A method of operating a heating, ventilation and air conditioning (HVAC) system includes determining a first heating or cooling demand for a first zone of a space and determining a second heating or cooling demand for a second zone of the space. The method determines that the first demand requires operation of the HVAC system in a first mode, and that the second demand requires operation of the HVAC system in a second mode opposite the first mode, and a simultaneous heat/cool algorithm is operated to alternatingly operate the HVAC system in the first mode to condition the first zone and the second mode to condition the second zone.

18 Claims, 4 Drawing Sheets

(56) References Cited

U.S. PATENT DOCUMENTS

| | | | | |
|---|---|---|---|---|
| 4,993,629 | A | 2/1991 | Wylie | |
| 5,024,265 | A | 6/1991 | Buchholz et al. | |
| 5,025,638 | A * | 6/1991 | Yamagishi | F24F 3/044 236/49.3 |
| 5,245,835 | A | 9/1993 | Cohen et al. | |
| 5,303,767 | A | 4/1994 | Riley | |
| 5,318,104 | A | 6/1994 | Shah et al. | |
| 5,860,473 | A | 1/1999 | Seiden | |
| 6,349,883 | B1 | 2/2002 | Simmons et al. | |
| 6,711,471 | B2 | 3/2004 | Kidder | |
| 6,792,766 | B2 | 9/2004 | Osborne et al. | |
| 6,983,889 | B2 | 1/2006 | Alles | |
| 7,130,720 | B2 | 10/2006 | Fisher | |
| 7,156,316 | B2 | 1/2007 | Kates | |
| 7,377,450 | B2 | 5/2008 | Strand et al. | |
| 7,542,824 | B2 | 6/2009 | Miki et al. | |
| 7,693,809 | B2 | 4/2010 | Gray | |
| 7,766,246 | B2 | 8/2010 | Mulhouse et al. | |
| 7,789,317 | B2 | 9/2010 | Votaw et al. | |
| 7,819,331 | B2 | 10/2010 | Arneson | |
| 7,967,218 | B2 | 6/2011 | Alles | |
| 8,141,623 | B2 | 3/2012 | Blecker | |
| 2010/0108290 | A1 | 5/2010 | Maxwell | |
| 2010/0242509 | A1 | 9/2010 | Lifson et al. | |
| 2010/0307733 | A1 | 12/2010 | Karamanos et al. | |
| 2011/0127340 | A1 | 6/2011 | Aiken | |
| 2011/0253796 | A1 | 10/2011 | Posa et al. | |
| 2012/0217315 | A1 | 8/2012 | Witbeck et al. | |
| 2012/0259469 | A1 | 10/2012 | Ward et al. | |
| 2013/0014927 | A1 * | 1/2013 | Dazai | F24F 3/044 165/208 |
| 2014/0349566 | A1 | 11/2014 | Lamb et al. | |

OTHER PUBLICATIONS

Oyabu et al., Air Conditioning System, Jun. 1992, JPH04161750A, Whole Document.*

"Variable Refrigerant Flow: Zoning Systems: 3-30 Tons"; Mitsubishi Electric & Electronics USA, Inc; Mitsubishi Electric: Cooling and Heating Systems, City Multi VRF Technology Catalog; 2011; 84 Pages Zone Thermal Equalizer Brochure; Villara Building Systems; Beutler Corporation; Copyright January 2012; 2 Pages.

* cited by examiner

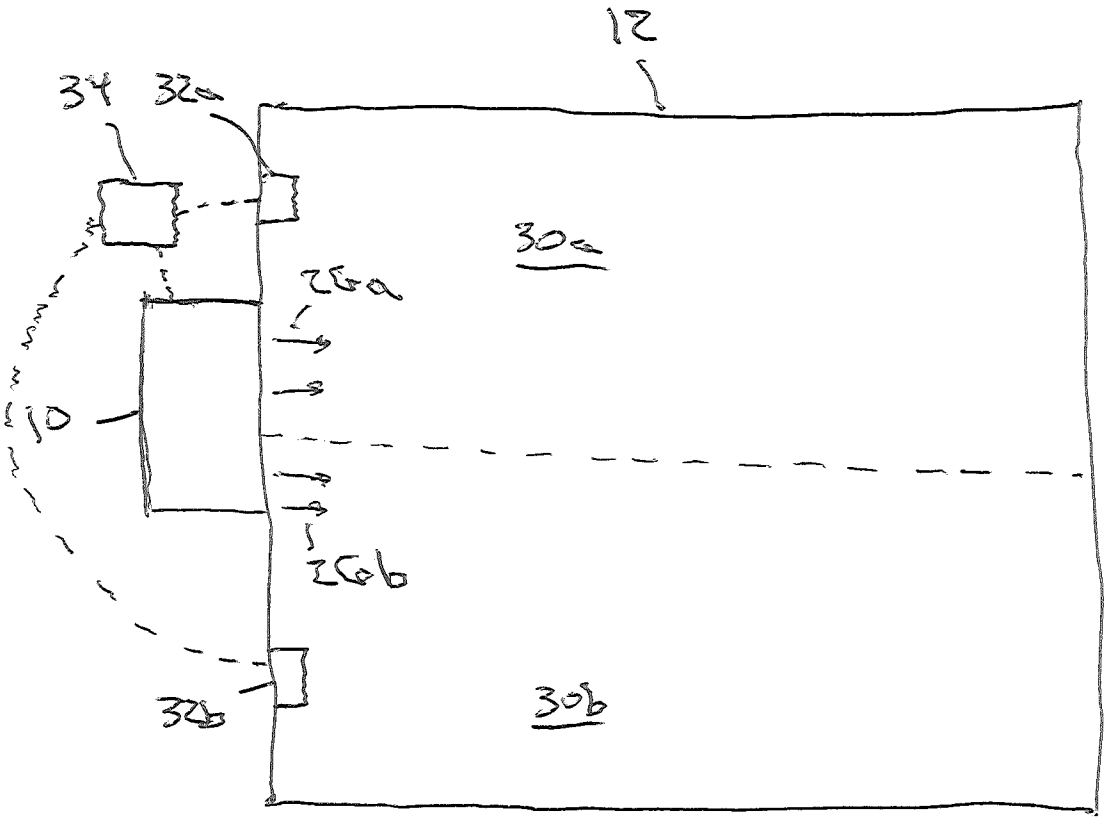
12
30a
30b
32a
32b
34
D

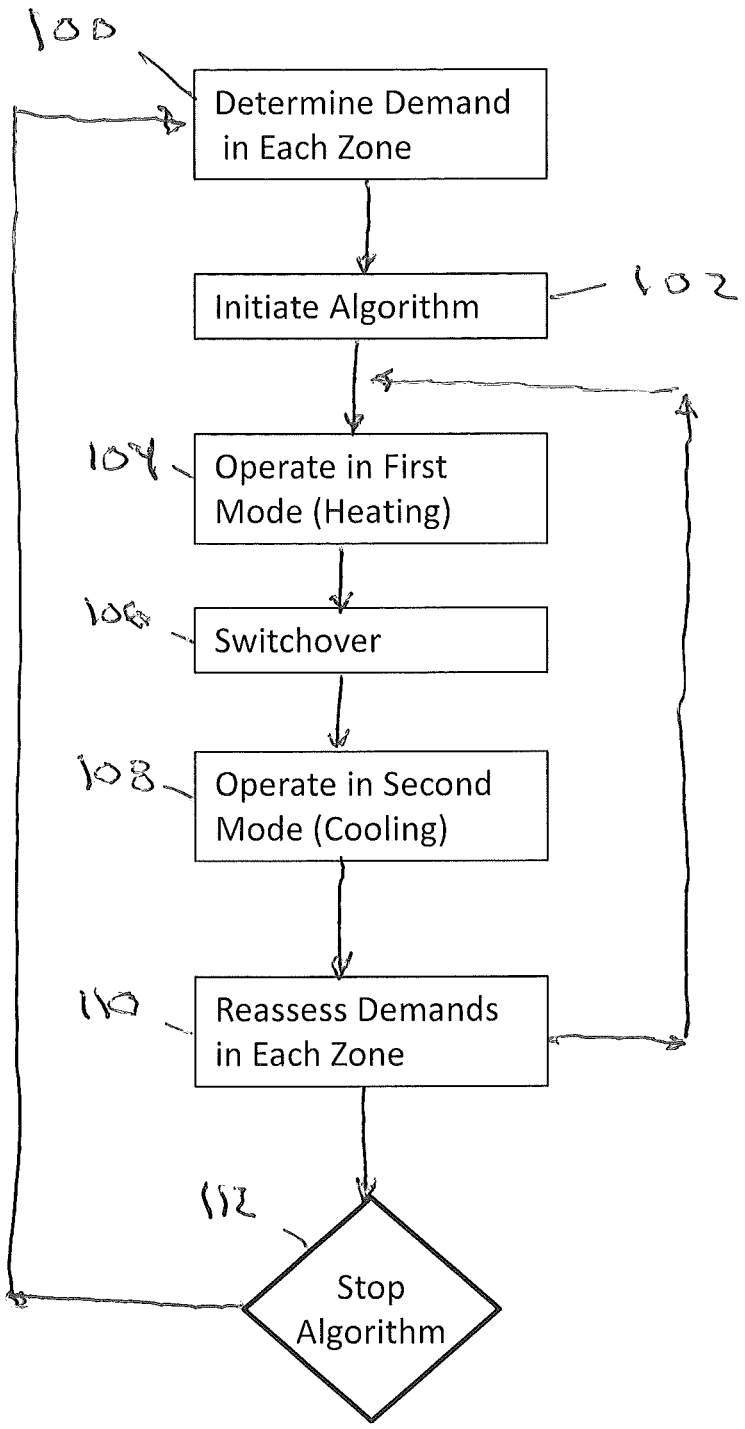
100
Determine Demand in Each Zone
Initiate Algorithm
102
104
Operate in First Mode (Heating)
106
Switchover
108
Operate in Second Mode (Cooling)
110
Reassess Demands in Each Zone
112
Stop Algorithm

SIMULTANEOUS HEATING AND COOLING OF MULTIPLE ZONES

BACKGROUND

The subject matter disclosed herein relates to heating, ventilation, and air conditioning (HVAC) systems. More specifically, the subject matter disclosed herein relates to operation of HVAC systems over multiple zones.

Many HVAC systems operate to heat and cool multiple zones of a structure or space independently. Each zone has a thermostat that communicates heating and cooling requirements of the particular zone to the HVAC system. In multi-zone systems, if one or more zones have a heating or cooling demand while other zone(s) simultaneously have the opposite demand, and both demands persist for a sufficient amount of time, it is possible for the system to continue to operate in one mode, meeting the demand of one or more zones, but leaving the zone(s) demanding the opposite mode underconditioned, by not addressing the demand.

In many HVAC systems, the thermostat communicates the heating or cooling requirements of a zone using simple On/Off control signals such as "Heat On", "Heat Off", "Cool On" and "Cool Off". Further, many thermostats generate these On/Off signals based on simple comparison of the actual zone temperature to the user's desired zone temperature (set point). For example, if the actual zone temperature falls more than a half degree below the zone's heating set point, "Heat On" is communicated. When the zone temperature rises to more than half a degree above the zone's heating set point, "Heat Off" is communicated. Some temperature "dead band" or "hysteresis", such as the exemplary half degree in each direction, is typically applied to prevent rapid cycling of the heating or cooling equipment.

As can be seen, the simple On/Off control systems have a tendency to satisfy, and even over-condition, each zone's demand as quickly as possible depending on the heating or cooling load(s) in the demanding zones and the available equipment capacity. For example, when all zones demanding heating are satisfied, the heating equipment can be turned off and the system can then be switched to cooling if any zone thermostats are communicating "Cool On" signals. In some circumstances, the system may be stuck in, for example, heating mode for a very long period of time without satisfying the demand. In such an example, the system would be unable to address an opposite cooling demand in other zones. Conversely, in some circumstances, the system may be stuck in cooling mode for a very long period of time without satisfying the demand. In such an example, the system would be unable to address an opposite heating demands in other zones.

Simple On/Off control systems tend to create a temperature "swing" around the user's desired set point resulting in hot and cold periods, reducing overall comfort. Also, simple On/Off systems are incapable of taking full advantage of modern multi-stage and variable capacity equipment. For this reason, some modern thermostats communicate the actual zone temperature and zone set point, from which the temperature error may be calculated as the difference. The system then generates equipment control responses "proportional" to the temperature error in each demanding zone. Some sophisticated controls go further and perform "proportional-integral" or PI control, which additionally accounts for how long the temperature error persists. PI control algorithms can assess the load demand in each zone and closely match it with the capacity delivered to the zone, utilizing staged or variable capacity equipment. This results in each zone's temperature remaining nearly constant close to its set point, while the equipment operates continuously for long periods of time. Comfort in the zones is significantly improved. However, the problem is that if some zones have a persistent demand for, say, heating, then the system may continue heating indefinitely. Meanwhile, if there is a simultaneous demand for cooling in other zones, it will remain unaddressed. The likelihood of the simultaneous heat and cool problem is greater with PI controls and variable capacity equipment compared to simple On/Off controls.

In many residential multi-zone systems, there may be occasional episodes of simultaneous heating and cooling demand in different parts of the home. Simultaneous heating and cooling demands, however, typically do not persist, with one of the demands for either heating or cooling typically going away over time. There are some cases, however, where the simultaneous demand persists. In such cases, the inability of the system to both cool and heat the multiple zones may result in noticeable discomfort. Such cases include, for example, a light commercial structure with a data center demanding cooling in a first zone in cold weather, while the remaining zones of the structure demand heating. A two story home with an occupied basement may require heating of the basement in the summer while the uppermost floor would require cooling. Further, a gathering in a home may cause cooling demands in that zone of the home, while the remaining zones may have a normal heating demand. Setting unusually aggressive set points, such as 72 degrees Fahrenheit cooling in one zone, with a heating set point of greater than 72 degrees Fahrenheit in the remaining zones, may exacerbate the problem.

Methods are available that may be used to help mitigate the simultaneous heat/cool problem. One method is to count the zones demanding each mode of operation and address the majority demand. For example if three zones are calling for heat while only two are for cool, the system heats. While this may help in some cases if one or more zones get satisfied and the majority switches, there can still be cases when the majority persists for a long time and the minority never gets any capacity. Another method, for systems where temperature errors can be calculated, is to address the zone with the largest absolute error. Again, this may help in some cases, if the error in the conditioned zone goes down and/or the error in the opposite mode unconditioned zone increases sufficiently to become the largest. However, this may still take a long time.

BRIEF SUMMARY

In one embodiment, a method of operating a heating, ventilation and air conditioning (HVAC) system includes determining a first heating or cooling demand for a first zone of a space and determining a second heating or cooling demand for a second zone of the space. The method determines that the first demand requires operation of the HVAC system in a first mode, and that the second demand requires operation of the HVAC system in a second mode opposite the first mode, and a simultaneous heat/cool algorithm is operated to alternatingly operate the HVAC system in the first mode to condition the first zone and the second mode to condition the second zone.

Additionally or alternatively, in this or other embodiments a relative duration of operation in the first mode and operation in the second mode are approximately proportional to a ratio of the first heating or cooling demand to the second heating or cooling demand.

Additionally or alternatively, in this or other embodiments a relative duration of operation in the first mode and operation in the second mode is determined based on the first heating or cooling demand and a first heating or cooling capacity compared to the second heating or cooling demand and a second heating or cooling capacity.

Additionally or alternatively, in this or other embodiments the HVAC system is operated in the first mode, switched from the first mode to the second mode and, operated in the second mode and then switched back to the first mode over a predetermined time duration.

Additionally or alternatively, in this or other embodiments the predetermined time duration is one hour.

Additionally or alternatively, in this or other embodiments the HVAC system operates in the first mode and operates in the second mode in fixed time increments.

Additionally or alternatively, in this or other embodiments the fixed time increments are 15 minutes in length.

Additionally or alternatively, in this or other embodiments the first heating or cooling demand and the second heating or cooling demand are reevaluated at periodic intervals and it is determined whether to continue with operation of the simultaneous heat/cool algorithm based on the reevaluation.

Additionally or alternatively, in this or other embodiments the reevaluation is performed every fifteen minutes.

Additionally or alternatively, in this or other embodiments the HVAC system is operated to deliver a stored capacity of the HVAC system prior to switching from the first mode to the second mode.

Additionally or alternatively, in this or other embodiments the alternating operation of the HVAC system in the first mode and second mode does not require satisfaction of the demand in either zone.

Additionally or alternatively, in this or other embodiments the first heating or cooling demand and opposite second heating or cooling demand persist for a predetermined amount of time before operating the simultaneous heat/cool algorithm.

In another embodiment, a heating ventilation and air conditioning (HVAC) system includes a heat exchanger operably connected to a first zone and a second zone of a conditioned space and a controller operably connected to the heat exchanger. The controller is configured to determine a first heating or cooling demand for a first zone of the space, determine a second heating or cooling demand for a second zone of the space, determine that the first demand requires operation of the HVAC system in a first mode, and that the second demand requires operation of the HVAC system in a second mode opposite the first mode, and operate a simultaneous heat/cool algorithm to alternatingly operate the HVAC system in the first mode to condition the first zone and the second mode to condition the second zone.

Additionally or alternatively, in this or other embodiments a relative duration of operation in the first mode and operation in the second mode are approximately proportional to a ratio of the first heating or cooling demand to the second heating or cooling demand.

Additionally or alternatively, in this or other embodiments a relative duration of operation in the first mode and operation in the second mode is determined based on the first heating or cooling demand and a first heating or cooling capacity compared to the second heating or cooling demand and a second heating or cooling capacity.

Additionally or alternatively, in this or other embodiments the HVAC system is operated in the first mode, switched from the first mode to the second mode and, operated in the second mode and then switched back to the first mode over a predetermined time duration.

Additionally or alternatively, in this or other embodiments the HVAC system operates in the first mode and operates in the second mode in fixed time increments.

Additionally or alternatively, in this or other embodiments the controller is further configured to reevaluate the first demand and the second demand at periodic intervals, and determine whether to continue with operation of the simultaneous heat/cool algorithm based on the reevaluation.

Additionally or alternatively, in this or other embodiments the controller is further configured to deliver a stored capacity of the HVAC system prior to switching from the first mode to the second mode.

Additionally or alternatively, in this or other embodiments the alternating operation of the HVAC system in the first mode and second mode does not require satisfaction of the demand in either zone.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIG. 3 is a schematic illustration of an HVAC arrangement for a multi-zone space; and FIG. 4 is an illustration of a method for operating an HVAC system.

The detailed description explains embodiments of the present disclosure, together with advantages and features, by way of example with reference to the drawings.

DETAILED DESCRIPTION

Figure 1:
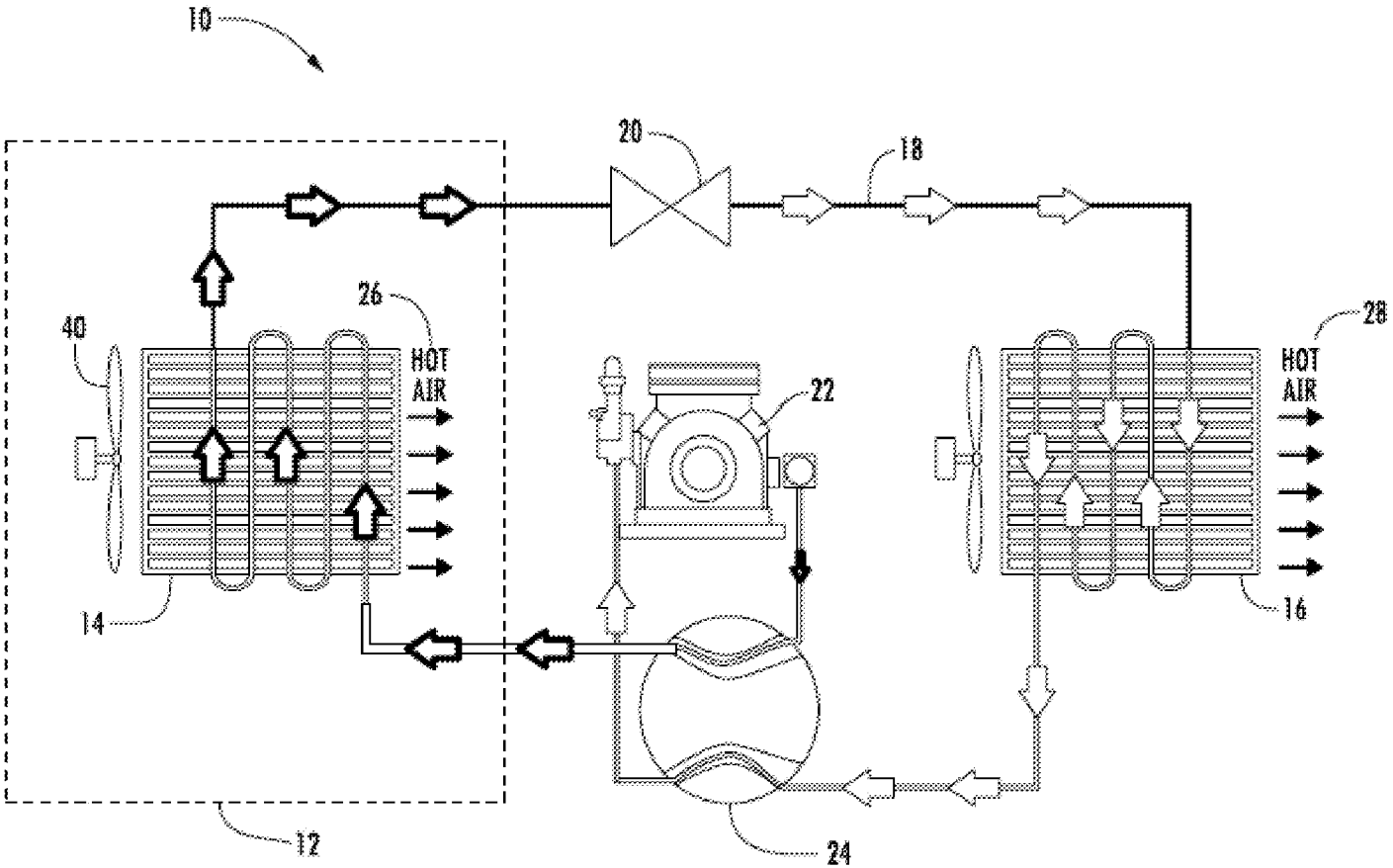
FIG. 1 is a schematic of operation of an embodiment of a heating ventilation and air conditioning (HVAC) system in heating mode.

Shown in FIG. 1 is a schematic of an HVAC system 10 for a space such as a building 12 or other structure. The HVAC system 10 may be a heat pump system as shown in FIG. 1, or alternatively another type of HVAC system 10. In FIG. 1, the HVAC system 10 includes an indoor heat exchanger 14 and an outdoor heat exchanger 16 connected by a refrigerant circuit 18. An expansion device 20 is located along the refrigerant circuit 18 between the indoor heat exchanger 14 and the outdoor heat exchanger 16, along with a compressor 22 and a reversing valve 24.

The illustration of FIG. 1 shows the HVAC system 10 in heating mode. In heating mode, refrigerant flows along the refrigerant circuit 18 from the outdoor heat exchanger 16 through the reversing valve 24 and into the compressor 22. The compressed refrigerant flow then proceeds through the indoor heat exchanger 14, resulting in an indoor air flow 26 for use in providing heat to the building 12. The refrigerant continues along the refrigerant circuit 18 through the expansion device 20 and to the outdoor heat exchanger 16 where, via thermal exchange, an outdoor airflow 28 is expelled, adding thermal energy to the refrigerant flow.

Figure 2:
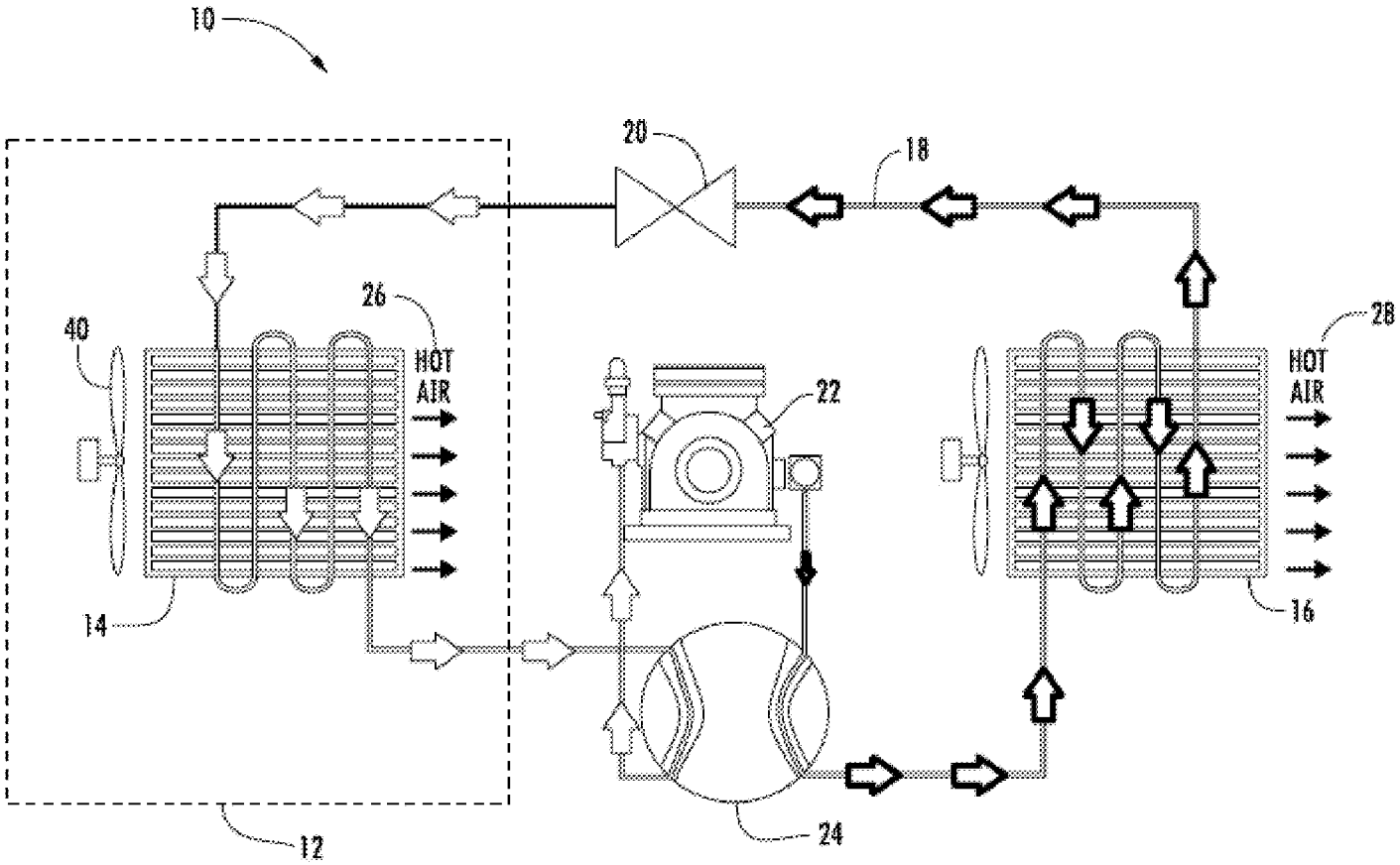
FIG. 2 is a schematic of operation of an embodiment of an HVAC system in cooling mode.

In cooling mode, shown in FIG. 2, the reversing valve 24 is moved to a cooling mode position, reversing the flow of refrigerant through the refrigerant circuit 18. The refrigerant flows from the compressor 22 through the reversing valve 24 and to the outdoor heat exchanger 16. From the outdoor heat exchanger 16, the refrigerant continues along the refrigerant circuit 18 through the expansion device 20 and to the indoor heat exchanger 14, where the indoor airflow 26 is generated to provide cooling to the building 12.

Referring now to FIG. 3, the building 12 or other structure or space may be divided into separate zones, such as 30*a* and 30*b*, with conditioning of the zones 30*a* and 30*b* controlled by thermostats 32*a* and 32*b* connected to HVAC system 10 via controller 34. While two zones 30*a* and 30*b* are shown in FIG. 3, it is to be appreciated that the disclosure herein is readily adaptable to other numbers of zones, for example, 3, 4 or more zones. In typical operation, the controller 34 directs the HVAC system 10 to provide conditioned indoor airflow 26*a*, 26*b* through separate ducting to the zones 30*a*, 30*b* based on temperatures at thermostats 32*a*, 32*b* and their respective set points. For example, each thermostat has a heating set point and a cooling set point. When the temperature at the thermostat 32*a* is below the heating set point, a heating demand is triggered and the controller 34 calls for the HVAC system 10 to provide heating to zone 30*a* via indoor airflow 26*a*. Similarly, when the temperature at the thermostat 32*a* exceeds the cooling set point, a cooling demand is triggered, with the controller 34 calling for HVAC system 10 to provide cooling to zone 30*a* via indoor airflow 26*a*. Alternatively demand can also be determined based on the temperature error in the zone or an approximately proportional integral control algorithm as described in the background. Operation with regard to heating and cooling of zone 30*b* is identical to that of zone 30*a* in most instances.

In typical operation one of the zones 30*a*, 30*b* will require heating or cooling, while the other zone 30*a*, 30*b* will require no action or require the same action. Under some conditions, however, both zones 30*a*, 30*b* will have demand, but the demand will be opposite. For example, the first zone 30*a* may require heating while the second zone 30*b* requires cooling, or vice versa. In such conditions, the controller 34 may start a simultaneous heat/cool control algorithm for operation of the HVAC system 10, as shown in FIG. 4 and described below.

First, in block 100, the controller 34 determines a heating or cooling demand for each zone 30*a*, 30*b* regardless of the mode (heating or cooling) the HVAC system 10 is currently operating in. In block 102, if demand in one of the zones 30*a*, 30*b* is opposite to the current mode and exceeds a predetermined threshold, optionally for a predetermined period of time, the controller 34 initiates the simultaneous heat/cool algorithm. For example, if the HVAC system 10 is operating in cooling mode to cool zone 30*b*, and zone 30*a* demands heating and is underconditioned, in this case underheated, by a predetermined threshold of at least 1 degree Fahrenheit for more than 15 minutes, the algorithm is initiated. In other embodiments, the amount of underheating or undercooling could be more or less than one degree and the amount of time could more or less than 15 minutes.

Once the algorithm is initiated, the controller 34 will switch the HVAC system 10 to alternatingly operate in heating mode in block 104 and to operate in cooling mode in block 108 over the course of a preset time period, in some embodiments one hour. Within each hour, the HVAC system 10 will heat and cool the respective zones 30*a*, 30*b* as needed. The heating and cooling is performed based on the relative heating and cooling demands. Further, the available heating and cooling capacity may also be considered. For example the heating and cooling times may be allocated approximately proportional based on the ratio of heating demand/heating capacity compared to cooling demand/cooling capacity. The heating and cooling modes are operated in time segments based on the demand/capacity comparison. For example, under some conditions, the first zone 30*a* may have a heating demand that is about 50% of a heating capacity of the HVAC system 10 while the second zone 30*b* has a cooling demand of about 100% of the cooling capacity of the HVAC system 10. Thus the HVAC system 10 will operate in cooling mode for a longer period of time to cool zone 30*b*, and the times may be approximately proportional to the relative demands and capacities, where the HVAC system 10 will operate in cooling mode for, for example, 45 minutes, and operate in heating mode for, for example, 15 minutes, of each hour while the simultaneous heat/cool control algorithm is operating to meet the conditioning needs of both zones 30*a*, 30*b*. In some embodiments, the time segments may be 15 minutes. In operation, for example, the HVAC system 10 may operate in heating mode for 15 minutes, and switch to cooling mode for the remaining 45 minutes of the hour, or the HVAC system 10 may operate in heating mode for 30 minutes and then switch to cooling mode for the remaining 30 minutes of the hour, or the HVAC system may operate in heating mode for 45 minutes and switch to cooling mode for the remainder of the hour. It is to be appreciated that the modes and times above are merely exemplary, and one skilled in the art will readily appreciate that modes of operation and/or durations may be changed to suit the needs of a particular HVAC system 10, building 12 or user.

At block 106, the system switches from a first mode (either heating or cooling) to a second mode (the other of heating or cooling). During switchovers from one mode to another mode, the cooling or heating operation is stopped for a timeframe, with only an indoor heat exchanger blower 40 (FIGS. 1 and 2) operating to deliver the remaining stored capacity to the requested zone 30*a*, 30*b* before restarting the other of heating or cooling modes. For example, when switching from heating mode 104 to cooling mode 108, the HVAC system 10 stops operation of the compressor 22 and merely operates the indoor heat exchanger blower 40 for a selected length of time, in some embodiments about 3 minutes, to purge stored heating capacity from the HVAC system 10 before reversing the reversing valve 24 and restarting the compressor 22 for operation in cooling mode 108.

The one hour cycle or "round trip" is selected to reduce discomfort in either zone 30*a* and 30*b* while allowing for adequate time for conditioning of each zone 30*a*, 30*b*. The "round trip" time may be adjusted as necessary or as selected by a user. For example, the heating/cooling cycle time may be greater or less than one hour. Further, in block 110, the demand in each zone 30*a*, 30*b* is reevaluated periodically for changes in demand, and the algorithm adjusts the times for cooling and heating accordingly. For example, the periodic reevaluation could be in 15 minute intervals. In some embodiments this reevaluation may occur at other time increments such as once per hour, or more or less than at 15 minute intervals.

Further, if either one of the demands is satisfied, the algorithm may be stopped at block 112 by the controller 34. For example, if the HVAC system 10 is operating in cooling mode to cool zone 30*b*, and zone 30*a* no longer has demand for heating or is underconditioned by less than 1 degree Fahrenheit, the simultaneous heat/cool algorithm is stopped.

The simultaneous heat/cool algorithm may be terminated after the heating or cooling demand has been satisfied optionally for a specified period of time. For example, no further demand in one of the modes (heating or cooling) for a 15 minute period of time. The system will then return to a normal single mode operation. Once the simultaneous heat/cool algorithm is stopped, the controller 34 returns to determining a heating or cooling demand for each zone 30*a*, 30*b* at block 100.

While the figures expressly depict an embodiment using a heat pump, it should be appreciated that the above-disclosed algorithm could be applied to a more traditional air conditioning type system paired with a hot air furnace, hot/cold water system, variable refrigerant flow type system, or any other system or combination of systems capable of heating or cooling multiple zones in a home or building.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A method of operating a heating, ventilation and air conditioning (HVAC) system comprising:

determining a first heating or cooling demand for a first zone of a space;

determining a second heating or cooling demand for a second zone of the space;

determining that the first demand requires operation of the HVAC system in a first mode, and that the second demand requires operation of the HVAC system in a second mode opposite the first mode, wherein the second demand is simultaneous to the first demand; and operating a simultaneous heat/cool algorithm for a predetermined time duration to alternatingly operate the HVAC system in the first mode for a first time portion of the predetermined time duration to condition the first zone and the second mode for a second time portion of the predetermined time duration to condition the second zone;

wherein a relative duration of operation in the first mode and operation in the second mode is determined based on the first heating or cooling demand and a first heating or cooling capacity compared to the second heating or cooling demand and a second heating or cooling capacity;

wherein the first time portion plus the second time portion sums to the predetermined time duration.

2. The method of claim 1, wherein a relative duration of operation in the first mode and operation in the second mode are approximately proportional to a ratio of the first heating or cooling demand to the second heating or cooling demand.

3. The of method of claim 1, wherein the HVAC system is operated in the first mode, switched from the first mode to the second mode and, operated in the second mode and then switched back to the first mode over a predetermined time duration.

4. The method of claim 3, wherein the predetermined time duration is one hour.

5. The method of claim 1, wherein the HVAC system operates in the first mode and operates in the second mode in fixed time increments.

6. The method of claim 5, wherein the fixed time increments are 15 minutes in length.

7. The method of claim 1, further comprising:

reevaluating the first heating or cooling demand and the second heating or cooling demand at periodic intervals; and determining whether to continue with operation of the simultaneous heat/cool algorithm based on the reevaluation.

8. The method of claim 7, wherein the reevaluation is performed every fifteen minutes.

9. The method of claim 1, further comprising operating the HVAC system to deliver a stored capacity of the HVAC system prior to switching from the first mode to the second mode, by stopping operation of a compressor of the HVAC system and operating a blower of the HVAC system to deliver the stored capacity.

10. The method of claim 1, wherein the alternating operation of the HVAC system in the first mode and second mode does not require satisfaction of the demand in either zone.

11. The method of claim 1, wherein the first heating or cooling demand and opposite second heating or cooling demand persist for a predetermined amount of time before operating the simultaneous heat/cool algorithm.

12. A heating ventilation and air conditioning (HVAC) system comprising:

a heat exchanger operably connected to a first zone and a second zone of a conditioned space; and a controller operably connected to the heat exchanger, the controller configured to:

determine a first heating or cooling demand for a first zone of the space;

determine a second heating or cooling demand for a second zone of the space;

determine that the first demand requires operation of the HVAC system in a first mode, and that the second demand requires operation of the HVAC system in a second mode opposite the first mode, wherein the second demand is simultaneous to the first demand; and operate a simultaneous heat/cool algorithm for a predetermined time duration to alternatingly operate the HVAC system in the first mode for a first time portion of the predetermined time duration to condition the first zone and the second mode for a second time portion of the predetermined time duration to condition the second zone;

wherein a relative duration of operation in the first mode and operation in the second mode is determined based on the first heating or cooling demand and a first heating or cooling capacity compared to the second heating or cooling demand and a second heating or cooling capacity;

wherein the first time portion plus the second time portion sums to the predetermined time duration.

13. The HVAC system of claim 12, wherein a relative duration of operation in the first mode and operation in the second mode are approximately proportional to a ratio of the first heating or cooling demand to the second heating or cooling demand.

14. The HVAC system of claim 12, wherein the HVAC system is operated in the first mode, switched from the first mode to the second mode and, operated in the second mode and then switched back to the first mode over a predetermined time duration.

15. The HVAC system of claim 12, wherein the HVAC system operates in the first mode and operates in the second mode in fixed time increments.

16. The HVAC system of claim 12, wherein the controller is further configured to:

reevaluate the first demand and the second demand at periodic intervals; and determine whether to continue with operation of the simultaneous heat/cool algorithm based on the reevaluation.

17. The HVAC system of claim 12, wherein the controller is further configured to deliver a stored capacity of the HVAC system prior to switching from the first mode to the second mode, by stopping operation of a compressor of the HVAC system and operating a blower of the HVAC system to deliver the stored capacity.

18. The HVAC system of claim 12, wherein the alternating operation of the HVAC system in the first mode and second mode does not require satisfaction of the demand in either zone.

* * * * *